United States Patent [19]

Rosselet

[11] 4,418,621

[45] Dec. 6, 1983

[54] MECHANISM FOR A ROTATING PROJECTILE FUZE

[75] Inventor: Jean Rosselet, Geneva, Switzerland

[73] Assignee: Mefina S.A., Fribourg, Switzerland

[21] Appl. No.: 246,159

[22] Filed: Mar. 23, 1981

[30] Foreign Application Priority Data

Apr. 1, 1980 [CH] Switzerland ..... 2553/80

[51] Int. Cl.[3] ..... F42C 15/22

[52] U.S. Cl. ..... 102/238; 102/244; 102/255

[58] Field of Search ..... 102/232, 238, 235, 244, 102/245, 254, 255

[56] References Cited

U.S. PATENT DOCUMENTS

| | | | |
|---|---|---|---|
| 1,127,999 | 2/1915 | Junghans | 102/238 |
| 1,915,890 | 6/1933 | Junghans | 102/238 |
| 1,970,207 | 8/1934 | Varaud | 102/232 |
| 2,420,324 | 5/1947 | Middlemiss | 102/238 |
| 2,531,121 | 11/1950 | Fink | 102/232 |
| 2,718,850 | 9/1955 | Kuhn | 102/238 |
| 3,972,290 | 8/1976 | Czajkowski et al. | 102/238 |

FOREIGN PATENT DOCUMENTS

| | | | |
|---|---|---|---|
| 343265 | 1/1960 | Switzerland | 102/238 |

*Primary Examiner*—David H. Brown
*Attorney, Agent, or Firm*—Emory L. Groff, Jr.

[57] ABSTRACT

The mechanism comprises two toothed rotary bodies (1,2) sensitive to the gyratory centrifugal force of the projectile. The rotary bodies (1,2) mesh with each other. The body (1) simultaneously meshes with a toothed pinion (9) the shaft (10) of which carries, for example, the escapement wheel of a delay device having a balance of the fuze. The rotary bodies (1,2) conjointly develop a substantially constant driving couple which is the resultant of positive driving couple of one of them and of a negative braking couple of the other.

4 Claims, 14 Drawing Figures

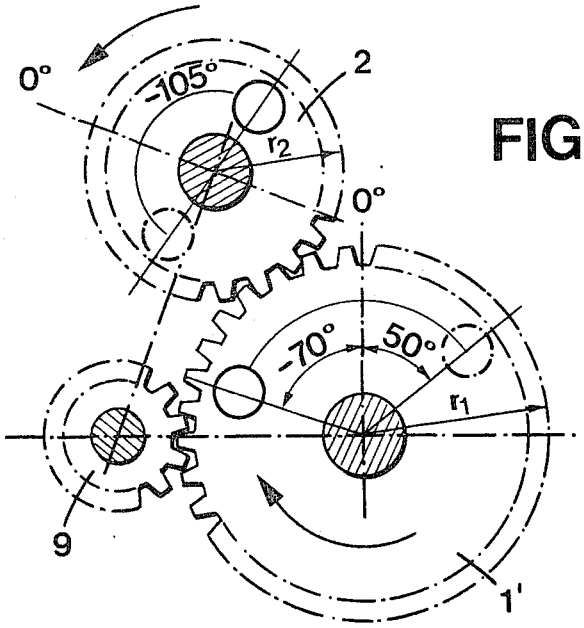
FIG. 5
FIG. 6
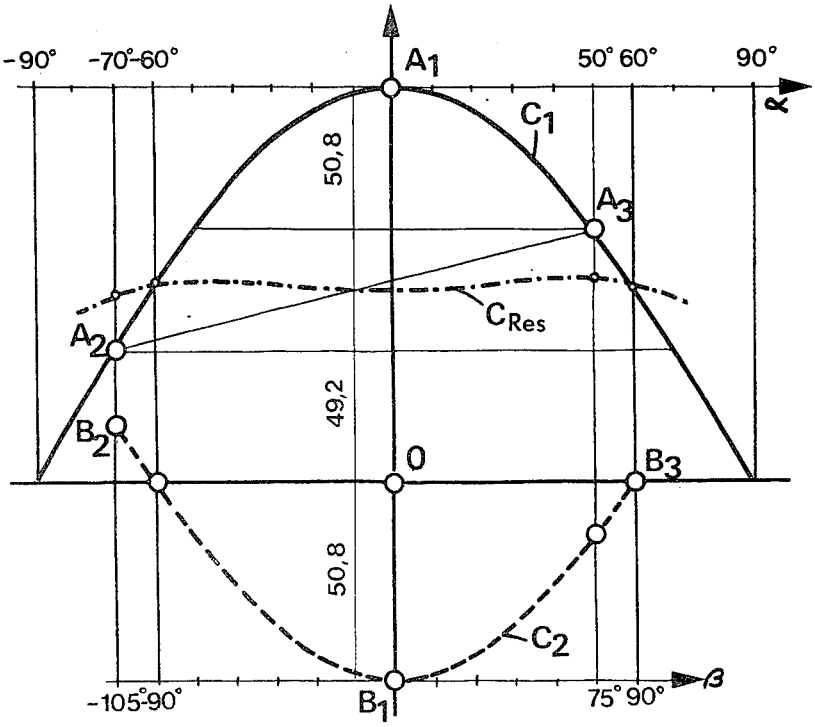

FIG. 13
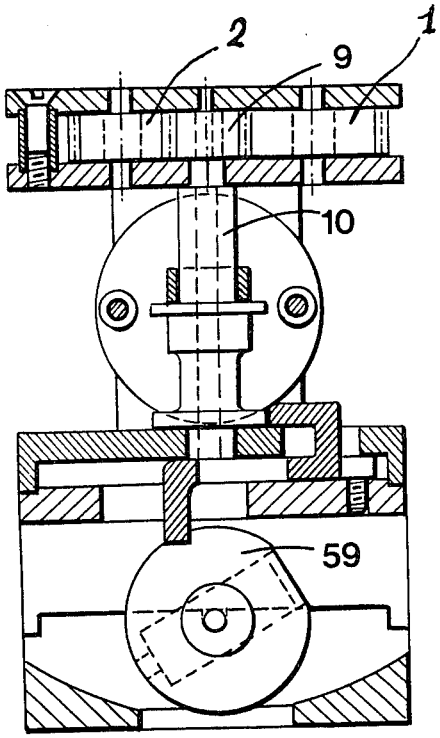
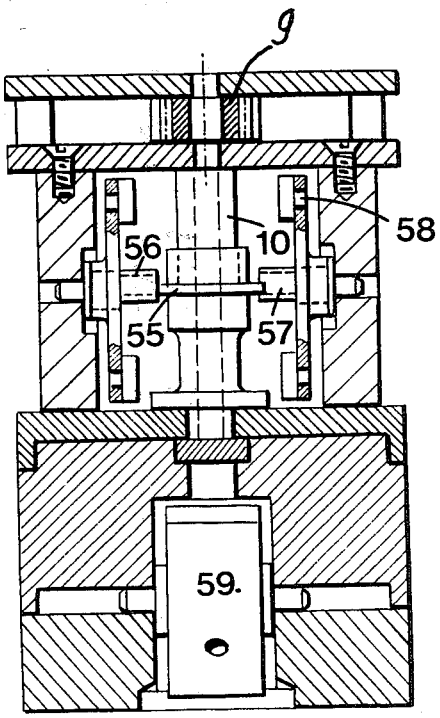
FIG. 14

MECHANISM FOR A ROTATING PROJECTILE FUZE

The present invention relates to a mechanism for a rotating projectile fuze, adapted mainly to co-operate with control, security and delay devices by providing them with a predetermined couple under the action of a centrifugal force.

Mechanisms of this type are already known in which the toothed pinion is driven by a weighted rack displaceable transversely to the axis of the fuze under the action of the gyratory centrifugal force of the fuze. These mechanisms present the disadvantage of developing a driving couple which increases linearly.

There are likewise known mechanisms in which the toothed pinion is driven by a toothed sector or a weighted wheel sensitive to the action of the gyratory centrifugal force of the fuze. These mechanisms present the disadvantage of developing a sinusoidal driving couple.

Consequently, none of these known mechanisms are suitable for the driving of regulator mechanisms which must be submitted to a substantially constant driving couple.

According to the present invention there is provided a mechanism for a rotating projectile fuze mainly adapted to co-operate with control, security and delay devices by providing them with a predetermined coupler under the action of a centrifugal force, characterized in that it comprises a primary rotary body and at least one secondary rotary body having their centres of gravity eccentric with respect to the axis of gyration of the projectile, meshing directly or indirectly between themselves, their two movements thus being interlocked, the two variable centrifugal forces produced by each of the bodies determining two variable centrifugal couples, in that, at rest, the relative positions of the centres of gravity of each of the bodies being chosen in a manner that the resultant couple which is the algebraic sum of the two centrifugal couples has the desired character.

The invention will be described further, by way of example, with reference to the accompanying schematic drawings, in which:

FIG. 5 is a view similar to FIG. 1 of a first modification;

FIG. 6 is a diagram of the driving couple developed by the mechanism represented in FIG. 5;

FIG. 13 is a cross-sectional view taken on the line 13—13 of FIG. 8 and FIG. 14 is a cross-sectional view taken at a right angle to the cross-sectional view of FIG. 13 representing the mechanism of FIG. 9 mounted on the trajectory safety device of the fuze.

Figure 1:
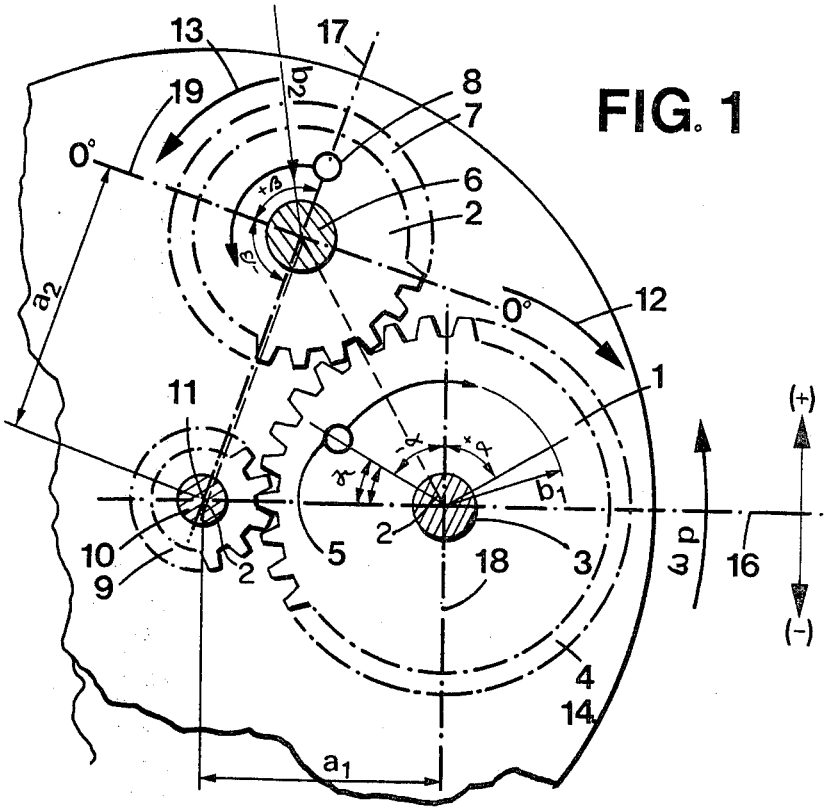
FIG. 1 is a cross-sectional view of a fuze.
Figure 2:
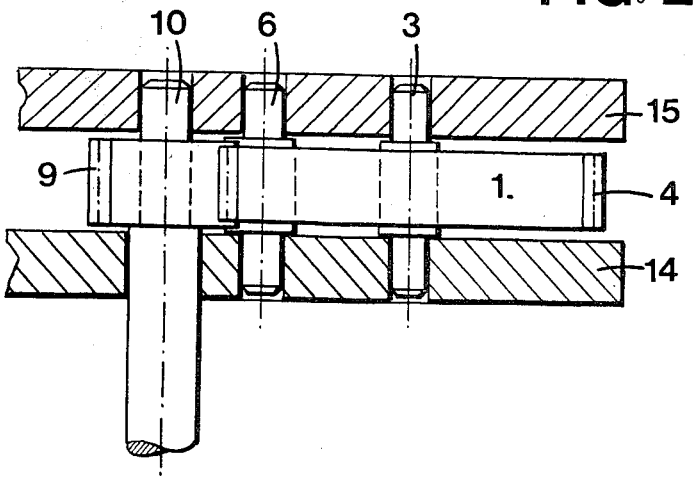
FIG. 2 is an axial section through the fuze on the line 2—2 of FIG. 1.

the mechanism represented in FIGS. 1 and 2 comprises a rotary moving body 1 and a rotary moving body 2. The moving body 1, which rotates on a shaft 3, is a wheel having a centre of gravity 5 and including a meshing toothing 4. The body 2, which rotates on a shaft 6, is a wheel having a centre of gravity 8 and including a meshing toothing 7. The toothing 7 of the body 2 meshes with the toothing 4 of the body 1. The movements of the two bodies 1 and 2 are interlocked. The body 1 meshes likewise with a toothed pinion 9 secured to a shaft 10 the axis of which coincides with the axis of gyration 11 of the projectile. The centre of rotation of the body 1 is at a distance $a_1$ from the centre of gyration 11. The centre of gravity 5 of the body 1 is at a distance $b_1$ from the axis of the shaft 3.

The centre of rotation of the body 2 is at a distance $a_2$ from the centre of gyration 11. The centre of gravity 8 of the body 2 is at a distance $b_2$ from the axis of the shaft 6.

The centrifugal mechanism is mounted in a fuze for a projectile and rotates at a speed $\omega_p$ around the centre of gyration 11. The centrifugal force produced by the angular rotation $\omega_p$ determines for each of the bodies 1 and 2 a sinusoidal centrifugal couple which has the value:

$$C=[m\cdot\omega_p^2\cdot a\cdot b]\sin\gamma=C_{maxi}\cdot\sin\gamma.$$

$\gamma$ being the angle which the radius passing through the centre of gravity forms with the straight line connecting the centre of gyration 11 with the pivotal centre (3 or 6) of the body considered.

The centrifugal couple $C_1$ turns the body 1 in the direction of the arrow 12. The centre of gravity 5 of the body 1 moves away from the centre of gyration 11. When the couple $C_1$ is positive; the body 1 is driving. The centrifugal couple $C_2$ turns the body 2 in the direction of the arrow 13. The centre of gravity 8 of the body moves near the centre of gyration 11. When the couple $C_2$ is negative; the body 2 is a brake or damper. The shafts 3, 6 and 10, are housed in bores of two plates 14 and 15, maintained and centred by crosspieces or struts (not shown).

The axis of shaft 10 passes through the centre of gyration 11 and the pivotal centre axis (16 or 17) of a body divides the plane into two zones, one zone where the couple is positive and one zone where the couple is negative. At the limit on either the axis 16 or 17 the corresponding couple is nil. When the centre of gravity of a moving body is on the perpendicular to one of the axes 16 or 17 and which passes through the point of rotation of the body, the centrifugal couple is maximum. The two perpendicular axes are represented at 18 and 19.

Figure 3:
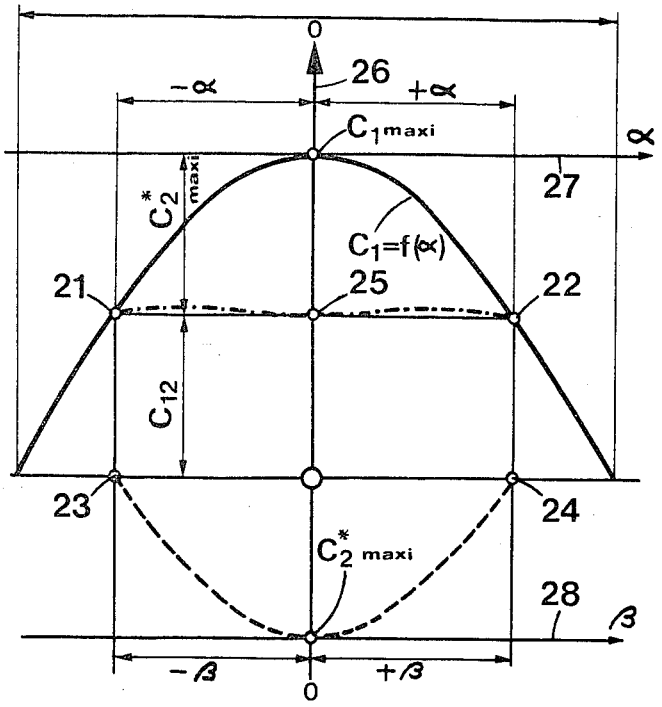
FIG. 3 is a first diagram of the driving couple developed by the mechanism represented in FIGS. 1 and 2.

There is graphically represented in FIG. 3 the values of the couples of the bodies 1 and 2, taking as the origin or zero point axes at right angles passing through the maximum couple. In this case, the couple formula becomes $$C_1=C_1\text{maxi}\cdot\cos\gamma \text{ and } C_2=C_2\text{maxi}\cdot\cos\beta$$

The body 1 executes one rotation from $-\alpha$ to $+\alpha$. The couple passes from the point 21 to the point 22. The body 2 executes a rotation from $-\beta$ to $+\beta$. The couple passes from the point 23 to the point 24, in passing by the point $C_{2maxi}^*$, which is the couple $C_2$maxi reduced at the axis of rotation of the body. One thus has:

$$C^*_{2maxi}=C_{2maxi}(r1)/(r2)$$

where $r_1$ and $r_2$ are the primitive radii of the toothings of the body 1 and 2.

The resultant couple is the algebraic sum of $C_1$ and $C^*_2$.

When the following condition is satisfied $C_{12}=C_{1maxi}+C^*_{2maxi}$; the point 25 is then obtained which is on the line 21–22. The resultant couple $C_{res}$ is represented in chain dotted lines from which it can be seen is practically constant.

As shown in the diagram of FIG. 3, the two couples $C_{1maxi}$ and $C^*_{2maxi}$ occur simultaneously; the two maxi couples are on the vertical axis 26; the angles $\alpha$ are read on the horizontal line 27 and the angles $\beta$ on the horizontal line 28.

In the example described, $\alpha$ varies from $-60°$ to $+60°$; $\beta$ varies from $-90°$ to $+90°$. The calculation indicates that the resultant couple varies from $\pm 1.6\%$.

Figure 4:
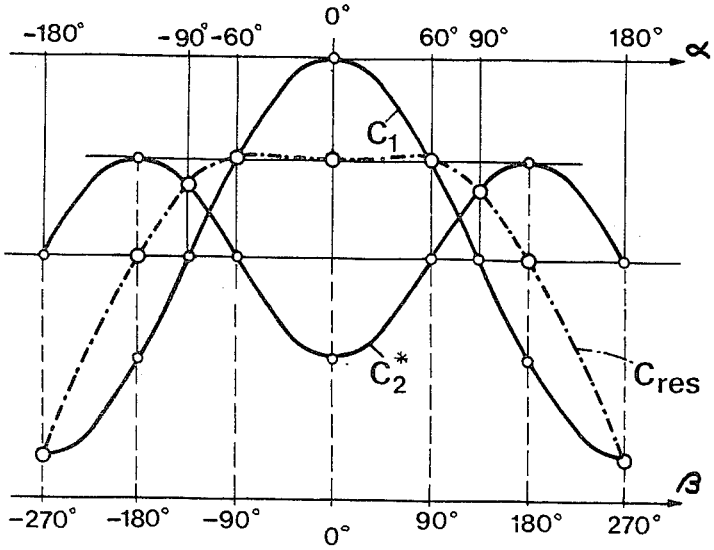
FIG. 4 is a second diagram of the driving couple developed by the mechanism represented in FIGS. 1 and 2.

There is shown in FIG. 4 the couples $C_1$ and $C^*_2$ for angles $\alpha$ varying from $-180°$ to $+180°$ and for angles $\beta$ varying from $-270°$ to $+270°$. The resultant couple $C_{res}$ varies little when $\alpha$ less than 90°, but enormously when $\alpha$ is greater than 90°.

There is shown in FIG. 5 a centrifugal mechanism similar to that of FIGS. 1 and 2. The two couples $C_{1maxi}$ and $C_{2maxi}$ occur simultaneously, but the rotation of the bodies is not symmetrical with respect to the axis of the maxi couples:

$\alpha$ varies from $-70°$ to $+50°$ and $\beta$ varies from $-105°$ to $+75°$. Likewise in this case, the body 1' is a prime mover and the body 2 is a brake.

There is graphically represented in FIG. 6 the values $C_1$ and $C^*_2$. The resultant couple $C_{res}$ is represented in chain dotted lines; one can see that it is practically constant. The calculation indicates that this resultant couple varies from $\pm 1.9\%$.

Figure 7:
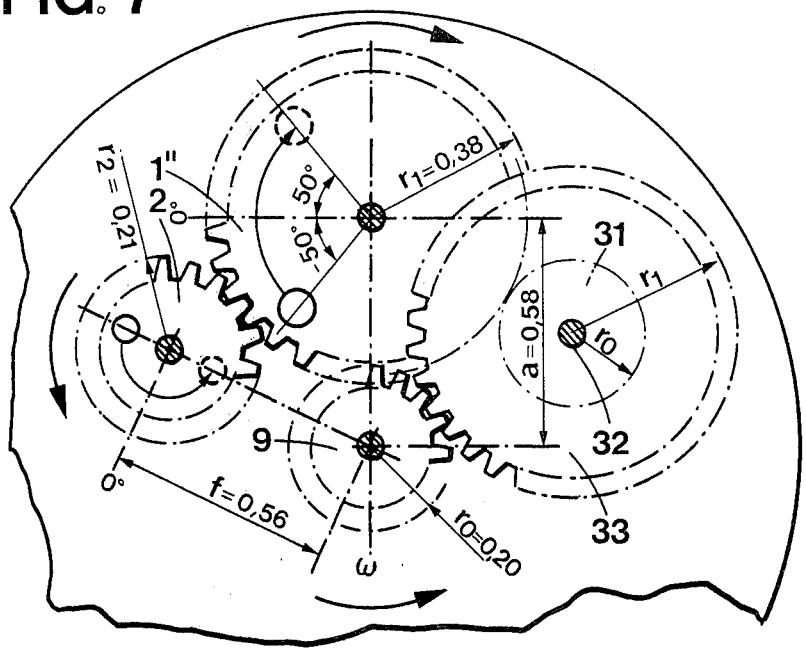
FIG. 7 is a view similar to FIG. 1 of a second modification.

In FIG. 7 a mechanical centrifuge is represented similar to the one of FIGS. 1 and 2 comprising a prime mover body 1'' and a body 2 serving as a brake. The prime mover body 1'' meshes with a pinion 31 pivoted at 32 and secured to a wheel 33 which meshes with the pinion 9. A speed multiplier has been introduced between the prime mover body and the pinion 9. The functioning of this mechanism is similar to that of the previously described mechanisms. In all the examples described above, the prime mover body 1'' meshes directly with the brake body 2 and the output of the centrifugal mechanism occurs on the shaft 10 of a pinion 9, the shaft which is located on the axis of gyration of the projectile.

However, the pinion 9 need not necessarily be placed on the axis of gyration; it can moreover mesh either with the prime mover body 1'', or with the brake body 2. The output of the centrifugal mechanism can equally well be effected either by the shaft 3 of the body 1'', or by the shaft 6 of the body 2.

Figure 8:
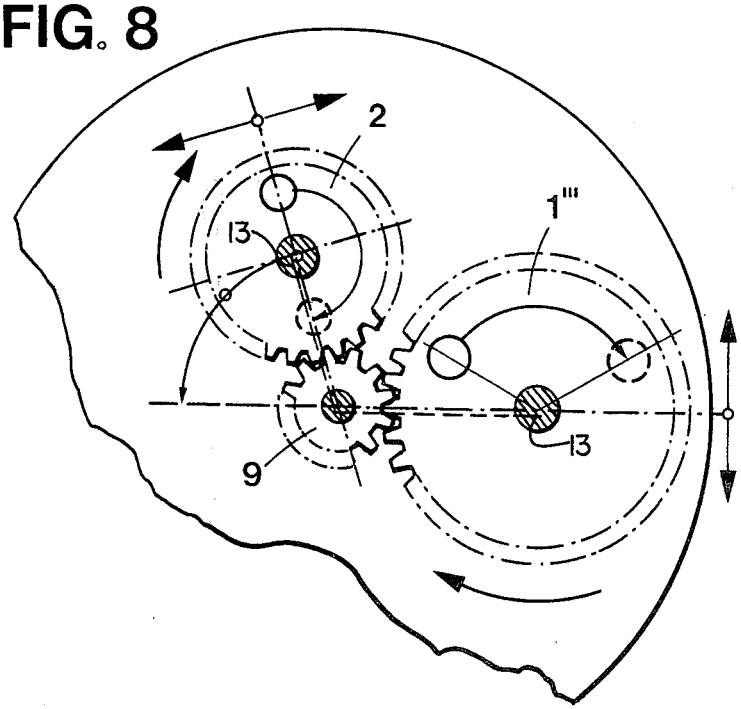
FIG. 8 is a view similar to FIG. 1 of a third modification.

In FIG. 8 a centrifugal mechanism is represented comprising a prime mover body 1''', the brake body 2 and the pinion 9; the bodies 1''' and 2 do not mesh directly. Their movements are interlocked via the pinion 9. The functioning is similar to that of the centrifugal mechanisms precedingly described.

Figure 9:
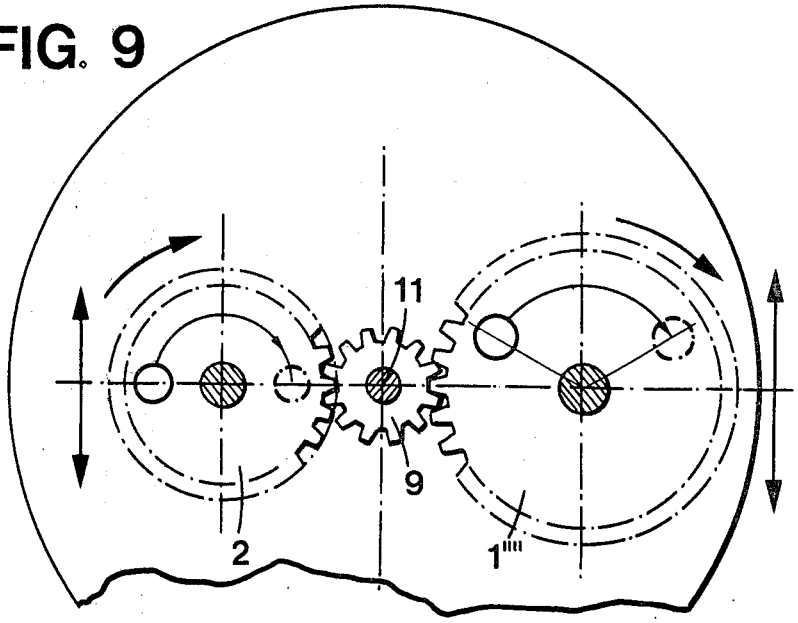
FIG. 9 is a view similar to FIG. 1 of a fourth modification.

In FIG. 9 a centrifugal mechanism is represented similar to the one described in FIG. 8 comprising the prime mover body 1'''', the brake body 2 and the pinion 9. The axes of the bodies 1'''' and 2 are on a diameter passing through the centre of gyration 11. A mechanism is thus produced which is symmetrical with respect to this axis.

In the example described, the bodies 1'''' and 2 are constituted by rotating masses. The wheels 1'''' and 2 can be replaced by rotating toothed sectors. The bodies 1'''' and 2 can comprise detachable masses permitting the exact fixing of the position of their centre of gravity. Alternatively, holes (perforation of the bend of the wheel) permitting fixing the position of the centre of gravity.

Figure 10:
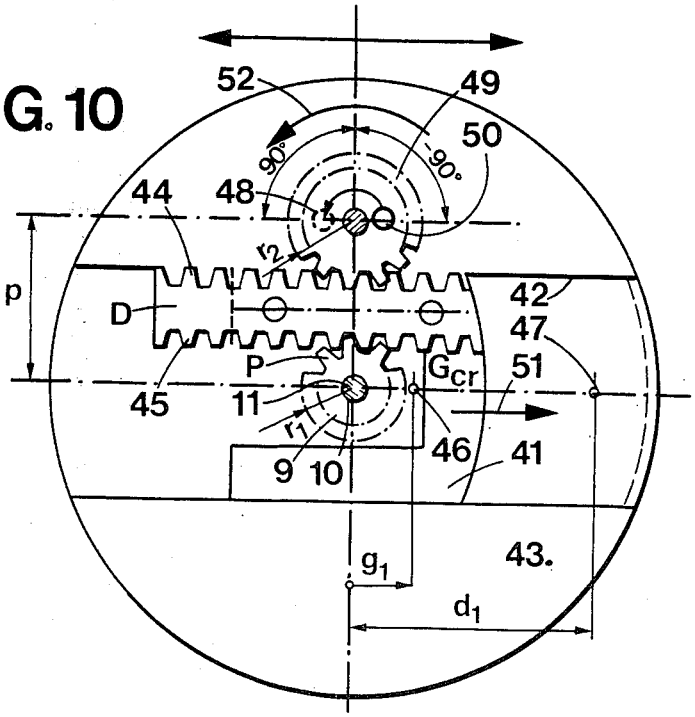
FIG. 10 is a view similar to FIG. 1 of a fifth modification.

In FIG. 10 a centrifugal mechanism is represented comprising a rack 41 guided in a diametrical housing 42 of a plate 43. The axis 11 of the plate is the centre of gyration of the projectile. The rack 41 comprises two meshing toothings 44 and 45. At rest, the centre of gravity of the rack 41 is at 46. Upon working, the centre of gravity is found at 47. The rack 41 replaces the prime mover bodies 1—1'''' in the preceding examples.

The toothing 44 of the rack 41 meshes with the toothing 48 of a toothed wheel 49. The toothing 45 of the rack 41 meshes with the pinion 9 secured to the shaft 10. At rest the centre of gravity of the toothed wheel 49 is at 50. The rack 41 is displaced in the direction of the arrow 51. The toothed wheel 49 rotates in the direction of the arrow 52. Consequently, the rack effects a radial displacement $d_1$, and the toothed wheel 49 effects a rotation from $+90°$ to $-90°$. The gyratory speed of the projectile is $\omega_p$. The centrifugal force of the rack 41 determines on the pinion 9 a driving couple proportional to the radius of the centre of gravity, thus a linear couple, whilst the centrifugal couple of the toothed wheel 49 is sinusoidal.

The position of the centre of gravity of the toothed wheel 49 is chosen in a manner that the centrifugal couple is nil, whilst the rack is at the middle of its displacement, that is to say when it has effected a path $^d1/2$. It is ascertained that, at the start, the toothed wheel 49 is driving and that, after a rotation of 90°, the wheel 49 becomes a brake. The functioning of this centrifugal mechanism is similar to that of the mechanisms previously described.

Figure 11:
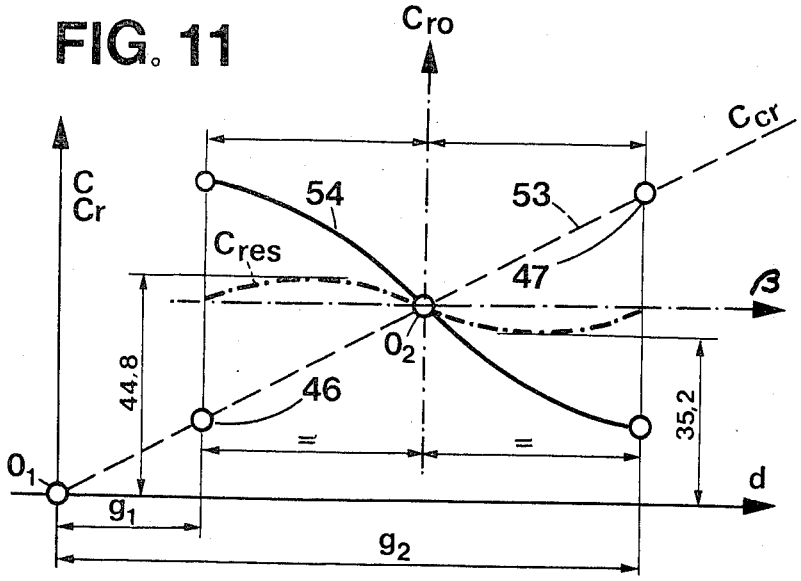
FIG. 11 is a diagram of the driving couple developed by the mechanism represented in FIG. 10.

FIG. 11 represents, diagrammatically, the centrifugal couples of the rack 41 and of the toothed wheel 49. The line 53 represents graphically the driving couple of the rack which is displaced from the point 46 to the point 47. The sinusoid 54 represents the couple of the toothed wheel 49. The resultant couple $C_{res}$ is represented in chain dotted lines.

For an angle $\beta$ of 90°, the calculation shows that the variations of the resultant couple $C_{res}$ are from $\pm 12\%$. These variations can be reduced if the diameter of the toothed wheel 49 is increased, if one reduces the value of $\beta$, because the sinusoid becomes more and more a straight line.

Figure 12:
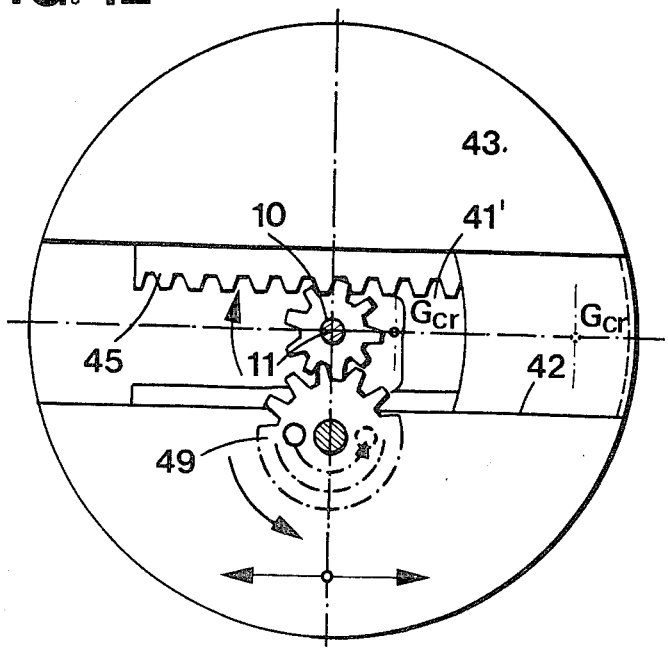
FIG. 12 is a view similar to FIG. 1 of a sixth modification.

There is represented in FIG. 12 a centrifugal mechanism comprising a rack 41 guided in a housing 42 of a plate 43. The axis of the plate is the centre of gyration of the projectile. The rack 41' comprises a toothing 45 which meshes with the pinion 9, secured to the shaft 10. The pinion 9 meshes with a toothed wheel 49. The functioning of this centrifugal mechanism is identical with that of the mechanism described above. The driving rack is not directly connected to the toothed wheel 49.

In all the examples described, the total angle of rotation of the brake wheel is greater than the total angle of rotation of the driving wheel. The prime mover body could serve temporarily as a brake, whilst the other body would temporarily be a prime mover.

It is sought to obtain a practically constant couple. The best solution is obtained when the maxi couples of the two bodies occur simultaneously.

The centrifugal mechanisms described can serve to entrain all sorts of mechanisms used in gyratory fuzes, such as speed regulators having escapements, safety, delay control and inertia mechanisms. They can equally well entrain an electric generator or an electric alternator for providing the energy which the fuze needs.

The centrifugal mechanisms of the type described could comprise a prime mover body and two brake bodies, or two prime mover bodies and two brake bodies, or any number of prime mover bodies associated to any number of brake bodies.

In FIGS. 13 and 14 the use of a mechanism comprising the bodies 1''' and 2 cooperating with pinion 9 in accordance with FIG. 8 is represented as the prime mover of a delay mechanism adapted to free the detonator safety mechanism of a fuze for a gyratory projectile.

The shaft 10, secured to the toothed pinion 9, carries the escapement wheel 55 of the delay mechanism which is thus started when the pinion 9 is rotated under the effect of a gyratory centrifugal force of the projectile. The teeth of the escapement wheel 55 co-operate then alternatively with the cylindrical sector 56, 57, of the balance 58, after freeing of this latter during commencement of firing, to maintain its oscillations and unlocking after a predetermined period of time the cap carrying rotor 59 of the fuze which then takes up its firing position, in known manner as shown and described in U.S. Pat. No. 4,291,628 dated Sept. 29, 1981.

I claim:

1. Driving means for the timing fuze of a gyratory shell adapted primarily to cooperate with control, security and delay devices by providing them with a predetermined couple under the action of centrifugal force, said driving means comprising a primary movable body and at least one secondary movable body, said bodies meshing directly or indirectly with each other, each of said bodies provided with a center of gravity eccentric with respect to the axis of gyration of said shell and a toothed pinion for actuating said control, security and delay devices meshing with at least one of said two movable bodies, said two movable bodies driving said toothed pinion simultaneouly in the same direction.

2. A mechanism as recited in claim 1, including a shaft on which said pinion is mounted, said shaft coinciding with the axis of gyration of the projectile.

3. A mechanism as recited in claim 1, wherein at least one of the bodies is a toothed wheel.

4. A mechanism as recited in claim 1, wherein at least one of the bodies is a rack displaceable transversely to the axis of the fuze.

* * * * *